United States Patent [19]

MacKinnon

[11] 4,102,094

[45] Jul. 25, 1978

[54] BOTTOM BRACE FOR CRANE

[75] Inventor: Alan G. MacKinnon, Newcomerstown, Ohio

[73] Assignee: The Foundation Equipment Corporation, Newcomerstown, Ohio

[21] Appl. No.: 617,200

[22] Filed: Sep. 26, 1975

[51] Int. Cl.[2] ..... E21C 11/00

[52] U.S. Cl. ..... 52/116; 173/43; 254/139.1

[58] Field of Search ..... 52/112, 115, 116, 117, 52/120, 121; 254/139.1; 173/28, 43

[56] References Cited

U.S. PATENT DOCUMENTS

| | | | |
|---|---|---|---|
| 2,692,169 | 10/1954 | Phillips | 52/121 |
| 2,827,772 | 3/1958 | Taylor, Jr. et al. | 52/117 X |
| 2,955,431 | 10/1960 | Taylor, Jr. | 52/120 X |
| 2,998,856 | 9/1961 | Larsen et al. | 52/115 X |
| 3,144,135 | 8/1964 | Brown | 173/28 X |
| 3,205,627 | 9/1965 | Gyongyosi | 52/116 X |
| 3,367,448 | 2/1968 | Wille | 52/121 X |
| 3,511,320 | 5/1970 | Miller | 52/116 X |
| 3,550,693 | 12/1970 | Bermingham | 173/43 |
| 3,588,050 | 6/1971 | Black et al. | 52/121 X |
| 3,708,024 | 1/1973 | Back | 173/28 |
| 3,768,575 | 10/1973 | MacKinnon et al. | 173/43 |
| 3,803,780 | 4/1974 | Donnelly | 52/120 X |
| 3,827,508 | 8/1974 | MacKinnon | 173/112 |
| 3,888,317 | 6/1975 | Walters | 52/115 X |

*Primary Examiner*—Leslie Braun
*Attorney, Agent, or Firm*—J. H. Slough

[57] ABSTRACT

There is disclosed herein a portable crane having a boom and lower brace supporting an elongated lead adapted to carry a pile driver, drill or other tool. The outer end of the brace has a capstan drive connected to a lead supporting line whereby the brace is movable vertically independently of the lead.

10 Claims, 6 Drawing Figures

BOTTOM BRACE FOR CRANE

This invention relates to cranes having elongated leads adapted to support a pile driver, drill or other tool. The invention is illustrated as applied to a portable crane of the type disclosed in U.S. Pat. Nos. 3,768,575 and 3,827,508 issued Oct. 30, 1973 and Aug. 6, 1974, respectively, and assigned to the assignee of the present application. It will be readily understood that the same is adaptable for use with other lead supporting cranes whether portable or nonportable.

As shown in the above-referred-to patents and other prior art, such as U.S. Pat. No. 3,550,693 issued Dec. 29, 1970, it is known to support an elongated lead to the end of a boom while guiding and steadying the lead adjacent to the bottom thereof by means of a generally horizontal, preferably longitudinally extendible brace or kicker. Thus the lead can be manipulated to the desired position and angle for operation of pile driver apparatus, drill means, or other tools. The outer end of the boom and brace are preferably slidably connected to the lead whereby the lead can be lowered or raised with respect thereto.

All of the known crane apparatuses of the general construction referred to have a common disadvantage; that is, when the boom is moved vertically the brace moves with it. Thus, when the lead is boomed down, the brace also goes down, thereby possibly striking an object on the ground, and when the lead is boomed up, the reverse action takes place and the brace is raised high off the ground which, under certain circumstances, may be undesirable. The prior art also discloses complex means for both retracting and raising a kicker assembly by pulling upwardly on a single line but such construction will not provide precise and independent positioning of the outer end of the brace or kicker assembly in the manner provided by the present invention.

The present invention comprises a crane having a drive means disposed adjacent to the outer end of the brace for independently adjusting the position of said outer end lengthwise of the lead.

An object of the invention is to provide a crane having a boom supporting a generally upright lead wherein the lower end of the lead is supported by a brace which is movable on the lead to avoid obstacles on the ground when the crane is booming down, stabilizes said lead when the crane is booming up, and places the brace along the lead at the best position for structural support in any operative position of the crane.

Another object of the invention is to provide a lead supporting crane having a movable brace as set forth above adapted to increase the effective extension or retraction of the brace.

Still another object of the invention is to provide a crane as set forth above wherein the movable brace is adapted to facilitate folding the boom and lead to a travel position.

Yet another object of the present invention is to provide a lead supporting crane having a brace slidably engaging the lead for movement lengthwise thereof and power means for driving the end of the brace along the lead.

A still further object of the invention is to provide a crane construction as set forth above wherein the brace is movable along the lead independently of movement of the lead.

Still another object of the invention is to provide the crane construction referred to wherein the aforesaid movement of said brace along the lead is independent of means for extending or retracting said brace.

Other objects of the invention and the advantages thereof will be readily understood from the following description of one embodiment of the invention as disclosed in the drawings wherein.

Figure 1:
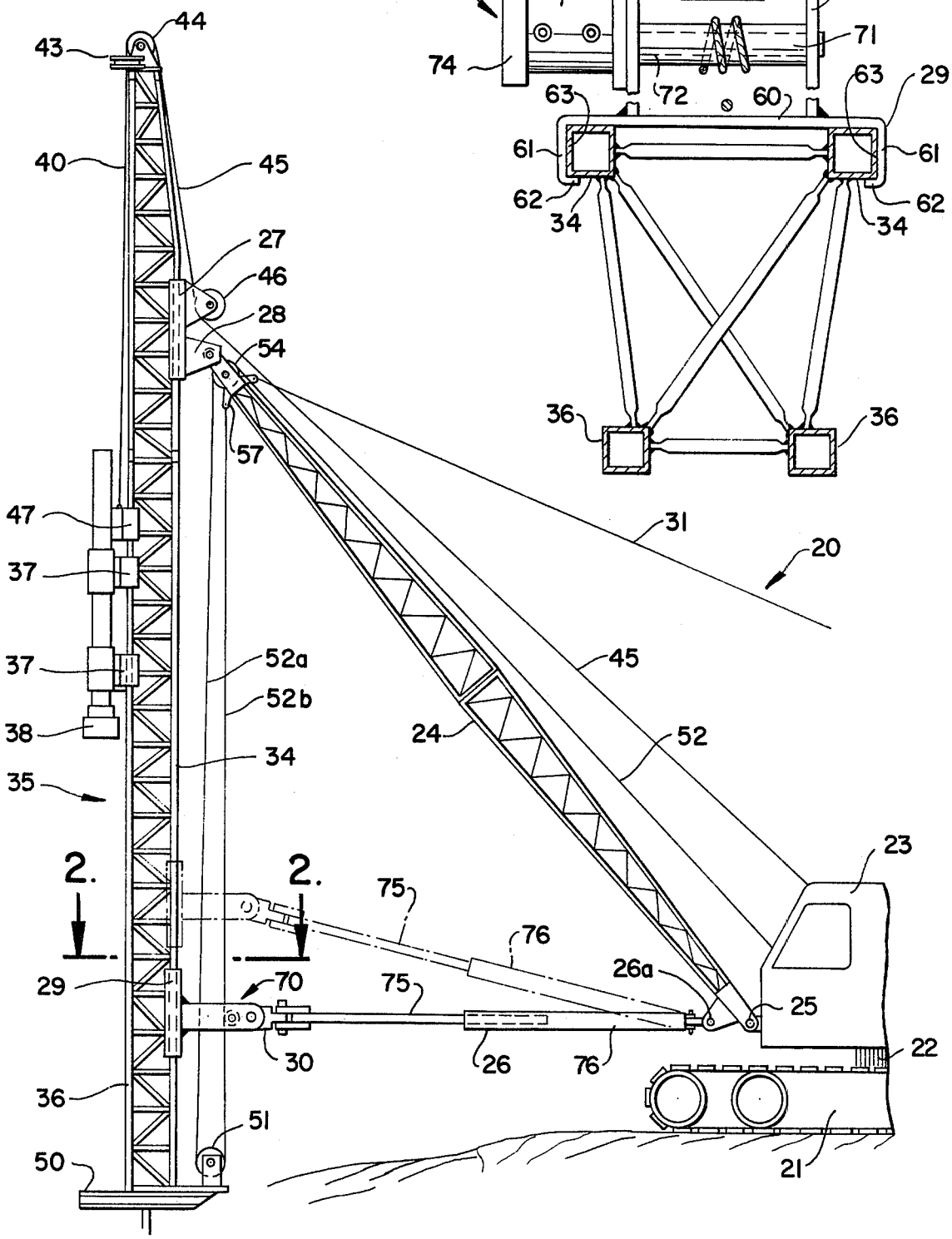
FIG. 1 is a side elevation of the front portion of a portable crane which carries an elongated lead supported adjacent to the top by a boom and guided adjacent to the bottom by a kicker or brace.

Referring now to the drawings in all of which like parts are designated by like reference numerals, and particularly to FIG. 1, numeral 20 designates a portable crane comprising a tractor portion 21 supporting a turntable 22 upon which a control cab 23 is mounted for pivotal movement about a vertical axis. A forwardly and upwardly projecting skeletal boom 24 is pivoted to the cab at a pivot 25, the upper end of the boom being connected to a boom rope 31 and the lower end of the boom having a forwardly projecting longitudinally adjustable brace 26 pivotally mounted thereto at its rearward end by a pivot means 26a. The outer end of the boom 24 carries a slide member 27 mounted to the boom by means of a universal joint 28, and the outermost or forwardly directed end of the brace 26 carries a slide member 29 connected therto by means of a universal joint 30. The slide members 27 and 29 engage parallel, laterally spaced rear corner frame members 34 disposed at the back of a skeletal type lead generally indicated at 35. The front of the lead 35 is defined by parallel, laterally spaced, elongated front corner frame members 36 adapted to receive slide members 37. The slide members 37 carry a hammer 38 adapted for vertical movement along the frame members 36 for driving a pile into the earth in a known manner. The pile driving hammer is illustrated by way of example of a tool which may advantageously be mounted upon the lead 35.

The lead 35 includes an upper end portion 40 having a head block 43 and a pulley 44 mounted to the upper end thereof. A hammer rope 45 extends from the control cab 23 under a pully 46 carried by the slide member 27 and over the uppermost pulley 44 from which it is directed downwardly to be connected to the upper end of a hammer tripping device 47.

The lowermost end of the lead is provided with a detachable foot yoke section 50 which is adapted to position the lower end of the lead with respect to a pile being driven. A pulley 51 is mounted at the back of the foot section a short distance rearwardly of the lead 35. A lead rope 52 extends from the cab 23 over a pulley 54 carried by the outermost end portion of the boom 24, downwardly and under the pulley 51 carried by the foot section 50, and upwardly to a fixed bracket 57 carried by the upper end portion of the boom 24 adjacent to the pulley 54. From the foregoing it will be readily appreciated that hauling in of the line 52 will raise the lead 35 and paying out of said line will cause said lead to lower, this vertical movement of the lead being possible due to the movable connections between the boom 24 and the brace 26 afforded by the slide members 27 and 29, respectively. It will further be noted that during the vertical movement of the lead 35 by hauling in or paying out the lead line 52, only the portion of said lead line which is disposed forwardly of the pulley 51 also has a vertical movement. This portion of the lead rope is designated 52a to distinguish it from the portion of the line disposed rearwardly of the pulley 51 which does not move vertically as long as it is on that side of the pulley and which is specifically designated as 52b. Thus, although the portion of the line designated 52b changes in length during vertical movement of the lead 35, it never moves vertically whereas the portion designated 52a both changes in length and moves vertically.

Figure 2:
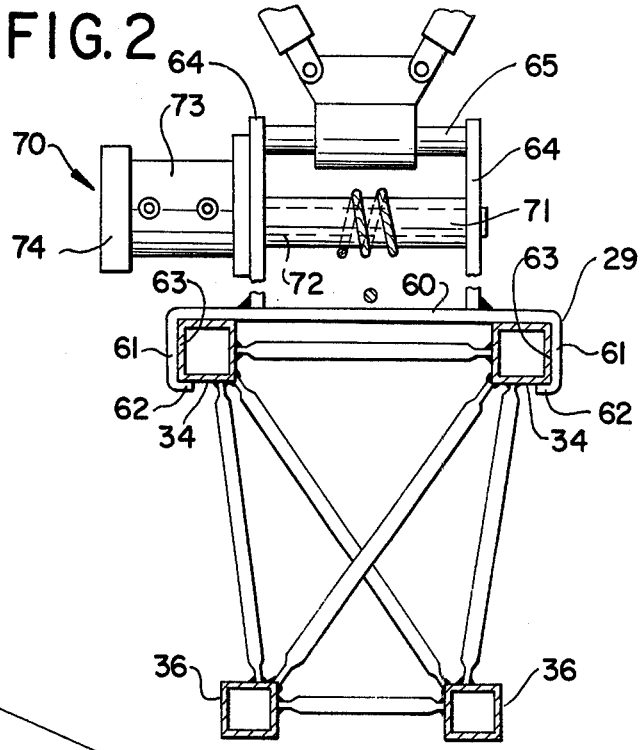
FIG. 2 is a transverse section through the lead taken along the line 2—2 of FIG. 1.
Figure 3:
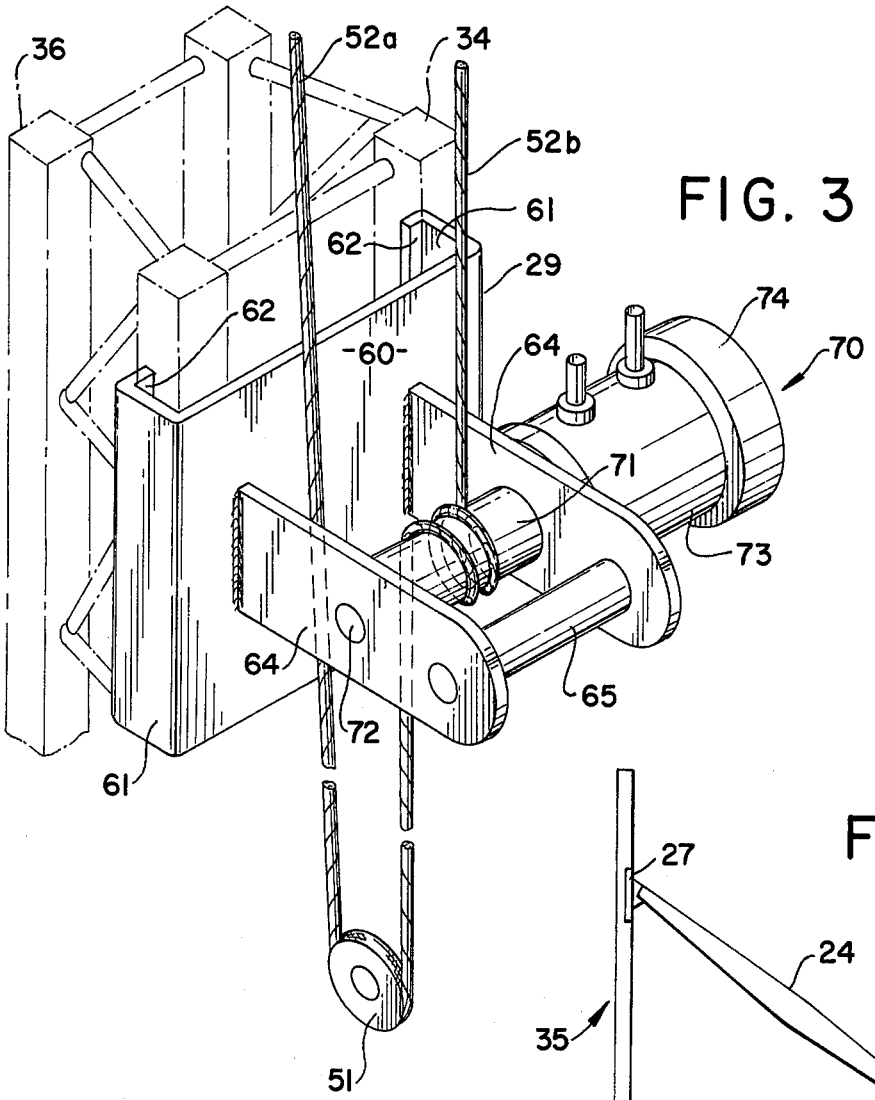
FIG. 3 is an enlarged detail of a capstan drive for vertically positioning the outer end of the kicker relative to the lead.

Referring particularly to FIGS. 2 and 3, it will be seen that the slide member 29 comprises a flat base plate 60 of sufficient width to bridge the two parallel rear corner frame members 34. The lateral edges of the base plate 60 are provided with forwardly disposed flanges 61 having inwardly turned lips 62 at the forwardly disposed edges thereof. The forwardly directed flanges 61 and the lips 62 in cooperation with the base plate 60 provide U-shaped channels or ways 63 at the lateral edges of the slide members 29 for slidably engaging the rear, side, and at least part of the forwardly facing surfaces of the corner members 34. Thus the entire slide can move vertically along the back of the lead 35 and the lead can move vertically with respect to said slide. The slide 27 at the upper end of the boom 24 is similarly constructed for slidably engaging the corner members 34.

The base plate 60 is provided with a pair of laterally spaced, rearwardly directed parallel arms 64 the distal end portions of which support an axially horizontal shaft 65. The shaft 65 provides one axis for the universal joint 30 carried by the outer end or forwardly directed end of the brace 26.

A capstan drive generally indicated at 70 is mounted on the arms 64 forwardly of the pivot shaft 65 of the universal joint 30 and rearwardly of the base plate 60. The capstan drive 70 comprises a drum 71 mounted upon a spindle 72. The spindle 72 and capstan drum 71 extend between the parallel arms 64 and are driven by suitable power means carried by one of the arms 64, such as a hydraulic motor and gear reduction assembly 73 having a suitable brake 74. The motor and brake assembly may be of any suitable known type providing means for driving the capstan drum 71 in either rotative direction and for providing preferably automatic braking when the drum is at rest.

The lead rope portions **52*a* and 52*b* both pass upwardly from the pulley 51 between the arms 64 of the slide member 29 forwardly of the universal joint shaft 65. The portion of the lead rope designated 52*b* which is suspended from the fixed bracket 57 is disposed adjacent to the capstan drum 71 and makes a plurality of turns around said drum whereby to afford a driving relationship between the slide 29 and the lead rope portion 52*b*. The lead rope portion 52*a* passes freely between the arms 64. The turns of the lead rope portion 52*b* around the capstan drum 71 tightly frictionally engage the drum whereby rotation thereof will cause the slide 29 to move upwardly or downwardly along the lead 35 regardless of whether said lead is itself in motion. Vertical movement of the slide 29 also vertically moves the outer or forwardly directed end of the brace 26 which said brace is free to take various angular positions due to the pivot means 26*a* and shaft 65** at the rearwardly and forwardly directed ends thereof, respectively.

From the foregoing it will be readily understood that the present crane construction can be operated in the manner of the cranes disclosed in the aforementioned patents of assignee (U.S. Pat. Nos. 3,768,575 and 3,827,508) when the capstan drive is not operating. Under those conditions, the slide member 29 and the outer or forwardly directed end of the brace 26 will remain at a fixed point on the lead rope portion **52*b* at a constant distance below the fixed bracket 57. Manipulation of the lead rope 52 by hauling in or paying out the same will cause vertical movement of the lead 35 without affecting the position of the brace 26 with respect to the boom 24. However, if the operator encounters a situation wherein the brace 26 may strike an object while booming down, the capstan drive 70 can be utilized to move the slide 29 and the outer end of said brace upwardly as shown in broken lines in FIG. 1. The brace 26 comprises relatively movable sections 75 and 76 whereby the length of said brace can be adjusted to maintain the desired position of the lead when the slide member 29 is moved vertically. The sections 75 and 76** as herein disclosed are relatively telescoped members and may be manually, mechanically, or hydraulically power adjusted in a known manner as desired.

Figure 4:
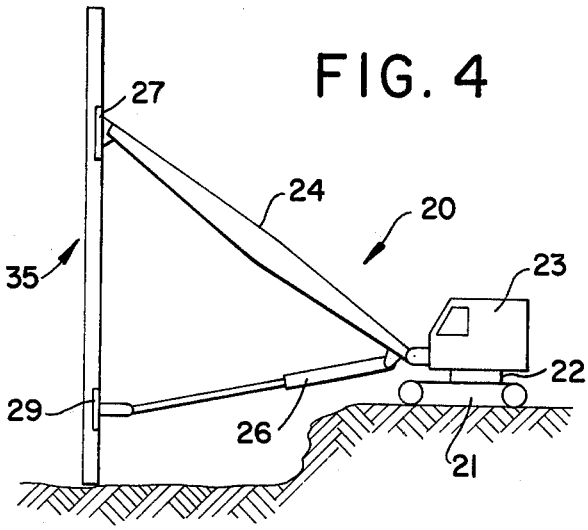
FIGS. 4 and 5 are simplified side elevations of the portable crane on a reduced scale showing the lead, boom, and brace in two different operative positions.

As illustrated in FIG. 4, the capstan drive 70 can be used to move the slide member 29 and the outer end of the brace 26 downwardly along the lead when this is desired to attain stability of the lead under circumstances where, for example, the lead is at rest on a surface lower than the tractor portion 21.

Figure 5:
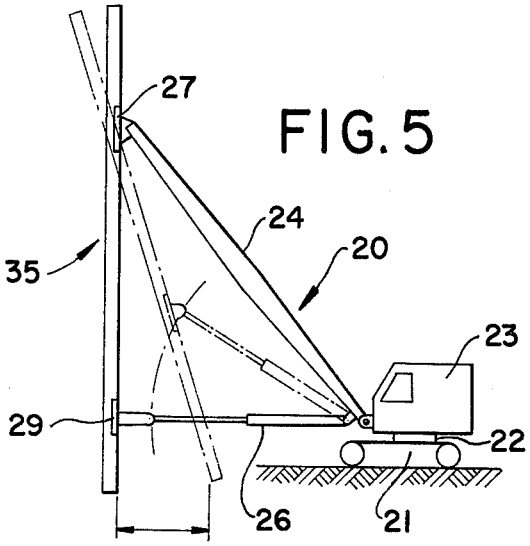

FIG. 5 illustrates the manner in which the lower end of the lead can be manipulated horizontally to a greater extent than that afforded by the adjustable sections 75 and 76 of the brace 26. For example, if the brace is fully retracted and it is desired to move the lower end of the lead even closer to the tractor, moving the outer end of the brace upwardly (or downwardly) from the horizontal will cause the lower end of the lead to move inwardly. In circumstances where the brace is fully extended but is at a position other than the horizontal, movement toward the horizontal position will move the end of the lead outwardly. Although this feature of the invention is shown in a somewhat exaggerated manner in FIG. 5 for clarity, it will be readily understood that the combination of the longitudinally extendible and retractable brace and the capstan drive affords very precise adjustment capabilities for positioning the lead.

Figure 6:
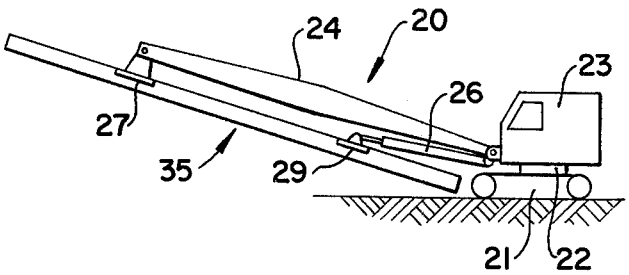
FIG. 6 is a view similar to FIGS. 4 and 5 showing the crane with the boom, lead, and brace folded in the travel position.

FIG. 6 illustrates the manner in which the brace 26 can be retracted and the outer end thereof moved upwardly along the lead to such point that both the lead and said brace literally fold against the boom 24 to the travel or transport position.

It will be appreciated by those familiar with the art that the present invention adds greatly to the flexibility and precise operation of a lead supporting crane and that the same is accomplished in a very effective manner. The outer end of the brace 26 can be quickly propelled in either direction along the length of the lead regardless of whether or not the length of the brace is changed and without affecting the length of the brace. This is the result of a direct drive relationship with a vertically nonmoving element which does not interfere with the freely sliding capabilities of the lead with respect to the brace. The need for a separate control line for raising or lowering the brace is eliminated in the form of the invention disclosed by this direct drive relationship with a vertically nonmovable portion of the lead rope itself. Whenever it is desired to use the crane in the manner described in the assignee's prior patents, it is only necessary to stop the capstan drive at the desired location whereby it will retain such position and act as a cable grip.

It will further be understood that many changes in the details of the invention as herein described and illustrated may be made without, however, departing from the spirit thereof or the scope of the appended claims.

I claim:

1. Crane apparatus comprising a control cab; an upwardly and forwardly angled boom pivotally attached at the lower end thereof to said cab; a generally forwardly projecting horizontal brace pivoted at one end thereof to a lower end portion of said boom; an elongated lead; upper and lower guide means carried at the outer forwardly directed ends of said boom and brace, respectively, and slidably engaging said lead adjacent to upper and lower portions thereof; a first pulley mounted adjacent to the lower end of said lead; a second pulley mounted adjacent to the upper end of said boom; a lead rope secured to an outer end portion of said boom, said lead rope comprising a first rope portion extending downwardly and around said first pulley; a second lead rope portion extending upwardly over said second pulley and rearwardly downwardly toward said control cab for raising and lowering said lead with respect to said guide means; said lower guide means having a pair of horizontally spaced, rearwardly projecting arms; connector means carried by the distal end portions of said arms connecting the forward end of said brace to said lower guide means; a power driven capstan rotatably mounted between said arms on an axis normal to said first lead rope portion, said first lead rope portion making a plurality of turns around said capstan for driving said lower guide means along said lead and independently of said lead in response to rotation of said capstan.

2. Crane apparatus as set forth in claim 1 wherein said capstan is provided with reversible motor drive means and braking means whereby said lower guide means can be propelled either direction along said lead and retained at any desired position on said lead.

3. A crane apparatus comprising an upwardly angled boom, the lower end of which is pivotally fixed, a generally horizontal brace, one end of which is pivotally fixed, said boom and brace being so pivotally fixed as to allow simultaneous movement in a given plane, an elongated lead, upper and lower guides carried at the outer ends of said boom and brace, respectively, and slidably engaging said lead adjacent to upper and lower portion thereof; a first pulley mounted adjacent to the lower end of said lead; a second pulley mounted adjacent to the upper end of said boom, a lead rope secured to an outer end portion of said boom, said lead rope secured to an outer end portion of said boom, said lead rope comprising a first rope portion extending downwardly and around said first pulley; a second rope portion extending upwardly over said second pulley for raising and lowering said led with respect to said guides by hauling in and paying said lead rope, respectively; said lower guide including a capstan, one of said rope portions making a plurality of turns around said capstan for independently slidably driving said lower guide lengthwise along said lead.

4. A crane apparatus as set forth in claim 3 wherein said capstan engages said first lead rope portion.

5. A crane apparatus as set forth in claim 4 wherein said capstan is provided with reversible drive means and braking means for retaining said lower guide and the outer end of said brace at a selected position on said lead.

6. In crane apparatus, an elongated lead; boom means having an outer end portion for engaging an upper portion of said lead; brace means having an outer end portion for engaging a lower portion of said lead; upper and lower guide means carried at the outer ends of said boom means and brace means and slidably engaging said lead at upper and lower portions thereof, respectively, lead moving means for raising and lowering said lead with respect to said upper guide means, said lead moving means being operatively connected to said lower guide means; and drive means associated with said lower guide means for coacting with said lead moving means for propelling said lower guide means lengthwise along said lead independently of said lead.

7. A crane apparatus comprising an elongated lead supported and positioned by at least a boom and a brace, each having one end pivotally fixed and an opposite end slidably mounted on said lead, rope means formed as a single, continuous line operatively connected to said lead and to said brace, first means for displacing said rope means to slidably move said lead with respect to said boom without moving said brace, and second means operatively connected to said rope means for displacing said rope means to slidably move said brace on said lead independently of said lead.

8. A crane apparatus in accordance with claim 10 wherein said rope means comprises a first portion fixed at one end to said boom and a second portion for slidably moving said brace with respect to said lead.

9. A crane apparatus in accordance with claim 11 wherein said second means comprises a capstan in driving engagement with said second portion.

10. A crane apparatus in accordance with claim 9 wherein said capstan is provided with reversible drive means and braking means for slidably moving and fixing said brace with respect to said lead.

* * * * *

UNITED STATES PATENT AND TRADEMARK OFFICE

CERTIFICATE OF CORRECTION

PATENT NO. : 4,102,094

DATED : July 25, 1978

INVENTOR(S) : Alan G. MacKinnon

It is certified that error appears in the above-identified patent and that said Letters Patent are hereby corrected as shown below:

In claim 3, column 5, line 58, "portion" should read -- portions --; column 6, lines 4 and 5, the phrase "said lead rope secured to an outer end portion of said boom" should be deleted; and line 9, "led" should read -- lead --.

In claim 8, column 6, line 47, cancel "10" and insert -- 7 --.

In claim 9, cancel "11" and insert -- 8 --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*